US006027168A

United States Patent [19]

Crossman et al.

[11] Patent Number: 6,027,168

[45] Date of Patent: Feb. 22, 2000

[54] CHAIR SEAT HORIZONTAL ADJUSTMENT MECHANISM

[75] Inventors: Philip E. Crossman, Grand Rapids; Bryan H. Zeeuw, Lowell, both of Mich.

[73] Assignee: Leggett & Platt, Inc., Carthage, Mo.

[21] Appl. No.: 09/093,009

[22] Filed: Jun. 5, 1998

[51] Int. Cl.[7] ..... A47C 1/623

[52] U.S. Cl. ..... 297/337; 297/322

[58] Field of Search ..... 297/337, 344.1, 297/341, 317, 322

[56] References Cited

U.S. PATENT DOCUMENTS

| | | | |
|---|---|---|---|
| 2,712,346 | 7/1955 | Sprinkle . | |
| 3,072,377 | 1/1963 | Blomberg . | |
| 3,232,574 | 2/1966 | Ferro . | |
| 4,054,318 | 10/1977 | Costin . | |
| 4,084,850 | 4/1978 | Ambasz | 297/337 |
| 4,768,829 | 9/1988 | Goldman . | |
| 4,834,453 | 5/1989 | Makiol . | |
| 5,035,466 | 7/1991 | Mathews et al. . | |
| 5,046,697 | 9/1991 | Detloff et al. . | |
| 5,380,062 | 1/1995 | Nania . | |
| 5,603,551 | 2/1997 | Sheehan | 297/322 |
| 5,607,204 | 3/1997 | Gryp | 297/337 |
| 5,755,488 | 5/1998 | Beda et al. | 297/337 |
| 5,782,536 | 7/1998 | Heidmann et al. | 297/337 |
| 5,810,439 | 9/1998 | Roslund, Jr. | 297/322 |

*Primary Examiner*—Anthony D. Barfield
*Attorney, Agent, or Firm*—Shook, Hardy & Bacon LLP

[57] ABSTRACT

In a chair having a base, a seat, a backrest, and a tilt control mechanism, a horizontal adjustment mechanism is provided for allowing fore and aft shifting movement of the seat relative to the backrest. The tilt control mechanism typically includes a pair of rails or other mounting structure by which the control mechanism is normally fastened to the seat. The rails present a pair of laterally spaced longitudinally extending edges and a plurality of mounting holes arranged in a predetermined pattern. The horizontal adjustment mechanism includes a seat mounting assembly provided with a pair of laterally spaced guides adapted to engage the edges of the rails to support the seat mounting assembly for sliding movement on the control mechanism. The seat mounting assembly presents at least one plurality of mounting holes by which it can be fastened to the seat, and these mounting holes of the seat mounting assembly are arranged in the same pattern as the holes in the rails so that the horizontal adjustment mechanism can be employed on the chair without requiring modification or added expense. Likewise, by employing the rails of the tilt control mechanism to support the guides of the seat mounting assembly, a low profile is presented that reduces the overall height of the seat above the ground.

20 Claims, 2 Drawing Sheets

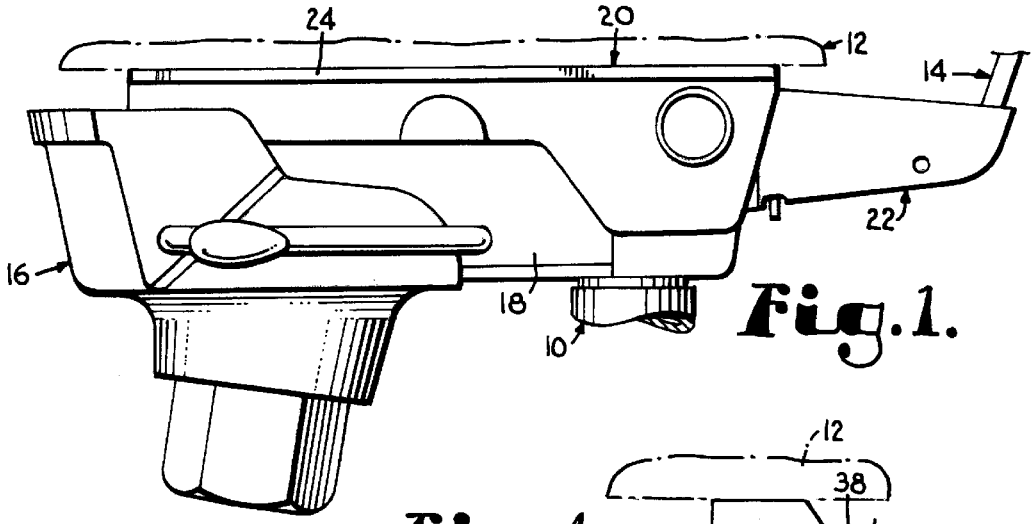
Fig.1.
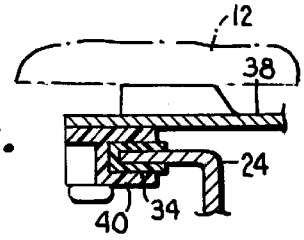
Fig.4.
Fig.2.
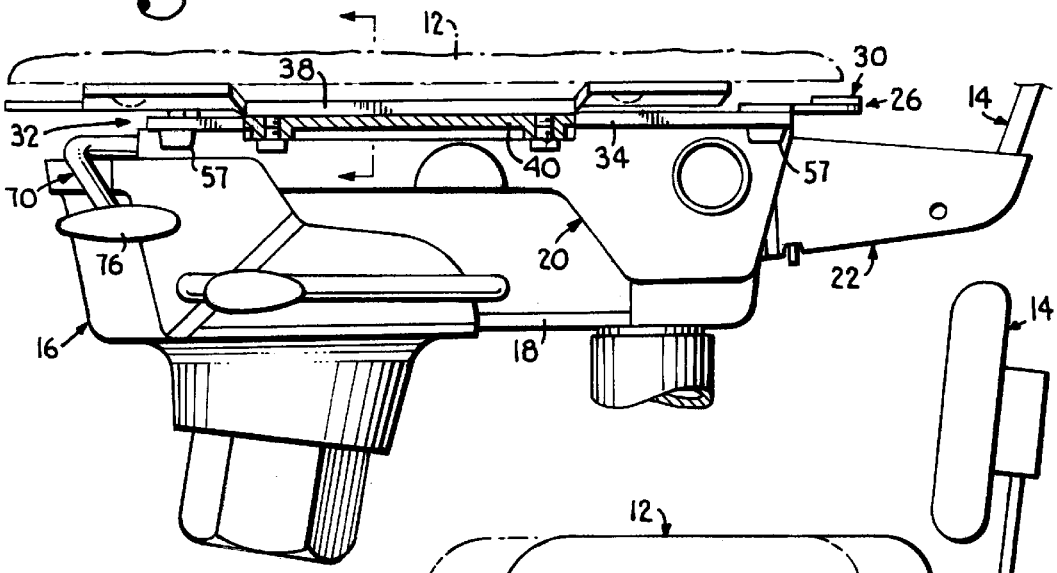
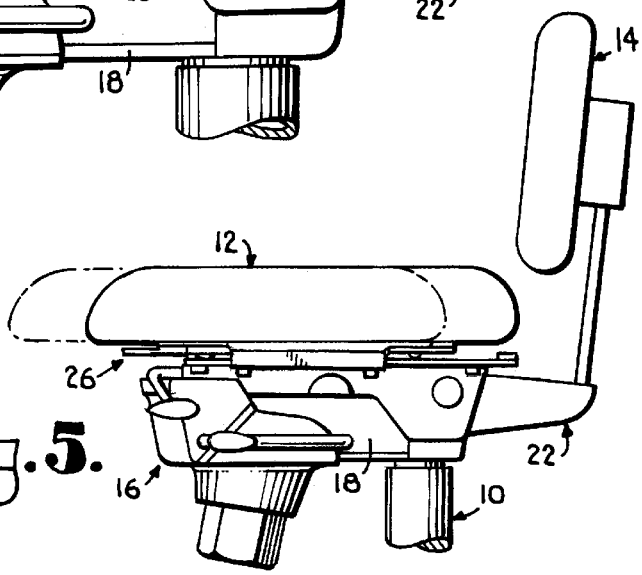
Fig.5.

CHAIR SEAT HORIZONTAL ADJUSTMENT MECHANISM

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

This invention relates generally to chair control mechanisms, and more particularly to a mechanism that allows the horizontal fore and aft position of a chair seat to be adjusted relative to the backrest thereof.

Conventional office chairs and the like are typically dimensioned to accommodate the largest number of human sizes possible. However, in employing such a compromise, known constructions fail to provide comfortable support to most human sizes varying from the norm. Although attempts have been made to construct chairs in which the relative positions of the seat and backrest are adjustable, such mechanisms are an expensive add-on to the cost of the chair, and increase the overall height of the seat such that it cannot be adjusted low enough to the ground to accommodate the fifth percentile female population.

BRIEF SUMMARY OF THE INVENTION

It is an object of the present invention to provide a horizontal adjustment mechanism for a chair, wherein the mechanism can be employed between a conventional seat and tilt control mechanism without requiring modification to either part, and presents a relatively low profile that does not significantly increase the overall height of the seat above the ground.

In accordance with these and other objects evident from the following description of a preferred embodiment of the invention, a horizontal adjustment mechanism is provided which is particularly suited for use on a chair having a base, a seat, a backrest, and a tilt control mechanism. Typically, the tilt control mechanism includes a pair of rails or other mounting structure by which the control mechanism is fastened to the seat. The rails present a pair of laterally spaced longitudinally extending edges and a plurality of mounting holes arranged in a predetermined pattern.

The horizontal adjustment mechanism includes a seat mounting assembly provided with a pair of laterally spaced guides adapted to engage the edges of the rails to support the seat mounting assembly for sliding movement on the control mechanism. The seat mounting assembly presents at least one set of mounting holes by which it can be fastened to the seat, and the at least one set of the mounting holes are arranged in the same pattern as the holes in the rails so that the horizontal adjustment mechanism can be employed on the chair without requiring modification to the other parts or adding significantly to the expense of the chair. Likewise, by employing the rails of the tilt control mechanism to support the guides of the seat mounting assembly, a low profile is presented that reduces the overall height of the seat above the ground relative to conventional constructions.

BRIEF DESCRIPTION OF THE SEVERAL VIEWS OF THE DRAWING

The preferred embodiment of the present invention is described in detail below with reference to the attached drawing, wherein:

FIG. 1 is a fragmentary side elevational view of a chair constructed in accordance with the prior art;

FIG. 2 is a fragmentary side elevational view of a chair constructed in accordance with the preferred embodiment of the present invention;

FIG. 4 is a sectional view of the horizontal adjustment mechanism, taken along line 4—4 of FIG. 2; and FIG. 5 is a fragmentary side elevational view of the chair, illustrating the range of fore and aft movement of a seat of the chair relative to a backrest thereof.

DETAILED DESCRIPTION OF THE INVENTION

Figure 3:
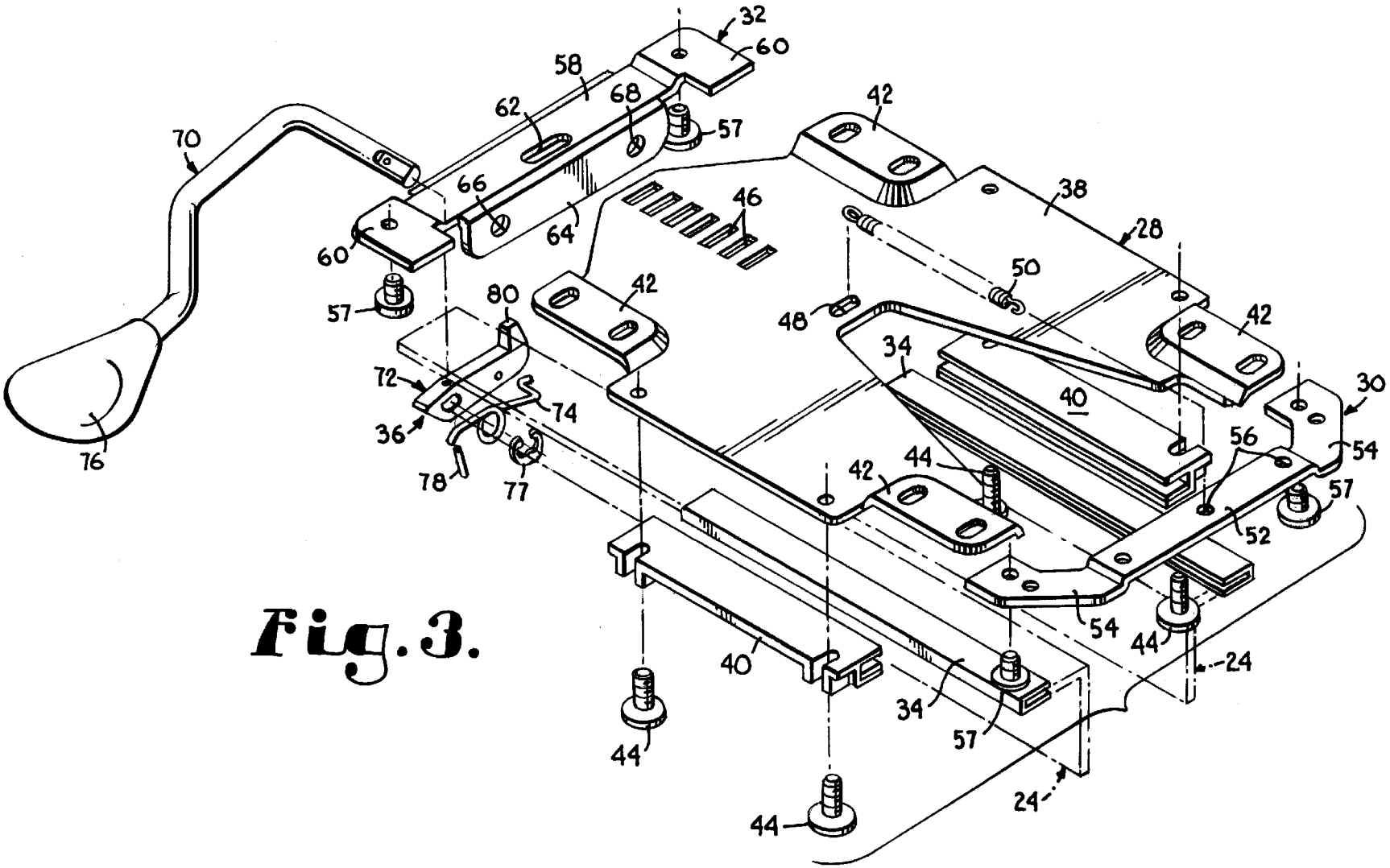
FIG. 3 is an exploded perspective view of a horizontal adjustment mechanism forming a part of the chair illustrated in FIG. 2.

A chair constructed in accordance with the prior art is shown in FIG. 1, and includes a base 10, a seat 12, and a backrest 14. The base includes a plurality of legs with casters for supporting the chair on the floor, and an upstanding spindle that supports a conventional gas cylinder for permitting the height of the seat to be adjusted. The seat is connected to the base through a control mechanism 16 and includes a rigid seat bottom and an upper cushion shaped to support a user in a seated position. The backrest is connected to an extension bar which, in turn, is connected to the base through the control mechanism. The backrest includes a rigid backing and a front cushion shaped to support the back of the user.

The chair control mechanism 16 generally includes a housing 18 supported on the base, a seat bracket 20 or other mounting structure secured to the seat and supported on the housing, a backrest bracket 22 secured to the backrest and supported on the housing, and a spring assembly connected between the housing and the seat and backrest brackets for biasing the seat and backrest toward an upright position. In addition, the mechanism can be provided with a height control assembly for actuating the gas cylinder to permit the height of the seat to be adjusted, a tilt control assembly for locking and unlocking the seat and backrest for tilting movement, and a forward travel-stop control assembly for permitting the forward tilted position of the seat and backrest to be adjusted.

The seat bracket 20 of the illustrated control mechanism 16 is preferably defined by a pair of laterally spaced metal rails 24 that are each independently secured to the seat 12 and supported on the housing 18 for pivotal movement. Each rail 24 includes a top wall presenting a longitudinally extending outer lateral edge and a plurality of mounting holes through which threaded fasteners can be inserted to secure the rail to the seat. The mounting holes are arranged in a pattern that corresponds with the pattern of holes formed in the rigid bottom of the seat 12 so that the rails can be easily aligned with and secured to the seat by a chair manufacturer. The walls also include depending side walls within which holes are formed for receiving pins used to attach the rail to the housing for relative pivotal movement.

Turning to FIG. 2, a chair constructed in accordance with the preferred embodiment of the present invention is illustrated as including the conventional elements shown in FIG. 1, as well as a horizontal adjustment mechanism 26. The particular constructions of the base 10, seat 12, backrest 14 and chair control mechanism 16 shown in the drawing do not form a part of the present invention and are provided for illustrative purposes only, it being understood that the present invention can be adapted for use with or in place of any known control mechanism for supporting the seat of a chair on the base so that the fore and aft position of the seat can be adjusted relative to the backrest.

The horizontal adjustment mechanism 26 of the preferred embodiment is adapted to be interposed between the seat 12 and the control mechanism 16 during assembly of the chair and, as shown in FIG. 3, generally includes a seat mounting assembly 28, a pair of end brackets 30, 32, a pair of tracks 34, and a locking assembly 36.

The seat mounting assembly 28 includes a mounting plate 38 adapted to be fastened to the rigid bottom of the seat, and a pair of depending channel-shaped guides 40 sized for sliding receipt over the outer lateral edges of the rails 24 of the control mechanism, shown in dashed lines. The mounting plate 38 is generally planer, presenting top and bottom surfaces and front, rear and side edges. Each comer of the mounting plate is stepped to present a raised profile portion 42 in which mounting holes are formed for receiving fasteners to fasten the plate to the seat. The mounting holes are arranged in sets, and each set presents a pattern identical to that of the mounting holes in the rails of the control mechanism and the seat such that the horizontal adjustment mechanism can be interposed between the control mechanism and the seat without requiring modification of either part. As such, the adjustment mechanism can be offered in combination with any conventional control mechanism to permit fore and aft adjustment of the seat of a chair relative to the backrest. Preferably, two sets of the mounting holes are formed in the mounting plate so that it can be assembled on the seat in either of a pair of different fore and aft positions. However, it is possible to form the plate with only a single set of mounting holes, or with any other suitable number of sets.

In addition to the mounting holes, the mounting plate 38 includes two pairs of tapped holes along the side edges thereof by which the guides 40 are secured to the plate by suitable fasteners 44. Further, a plurality of longitudinally spaced slots or apertures 46 are formed in the plate along the central axis thereof, and are adapted to cooperate with the locking assembly 36, as described below. Optionally, a further aperture 48 can be formed in the plate to the rear of the slots 46, and is adapted to seat a tension spring or springs 50 used to bias the seat mounting plate toward a rearward most position.

The guides 40 are substantially identical to one another, each including an upper bearing surface, a pair of notches for receiving the fasteners 44, and an inwardly opening U-shaped channel that is oversized relative to the edge thickness of the rails 24. As such, the guides can be secured to the mounting plate 38 so that the plate and guides can be translated as a unit along the rail edges fore and aft of the chair. The notches in the guides 40 facilitate proper cooperation between the mounting assembly and the rails 24 by permitting the guides to be adjusted laterally during assembly so that the assembly 28 slides smoothly along the rails. Preferably, the guides 40 are formed of a synthetic resin material such as nylon or the like to reduce frictional resistance. Other materials exhibiting similar properties may also be employed.

The rear end bracket 30 of the horizontal adjustment mechanism is preferably formed of metal or any other suitably rigid material, and is generally C-shaped, presenting an intermediate portion 52 extending laterally between a pair of longitudinally extending ends 54. Each end of the bracket includes a mounting hole by which the bracket can be fastened to the existing mounting holes at the rear ends of the rails by fasteners 57 so that the bracket 30 remains fixed to the rails 24 during shifting movement of the seat and seat mounting assembly. Preferably, a plurality of longitudinally spaced mounting holes are provided in each end of the bracket so that the position of the bracket along the rails can be selected during assembly to adjust the range of movement to be afforded the seat and seat mounting assembly. In addition, the intermediate portion 52 may be provided with one or more apertures 56 for seating the tension spring 50 to bias the seat toward the rearward most position.

The front end bracket 32 is also preferably formed of metal or the like, and presents an intermediate portion 58 extending laterally between a pair of longitudinally extending ends 60. Each end of the bracket includes a mounting hole by which the bracket can be fastened to the existing mounting holes at the front ends of the rails by fasteners 57 so that the front bracket remains fixed to the rails during shifting movement of the seat and mounting assembly. The intermediate portion 58 of the bracket 32 presents a generally central aperture 62, and includes depending front and rear walls 64 in which longitudinally extending holes 66, 68 are formed. Preferably, the two pairs of holes are formed in the bracket walls to facilitate both right and left handed assembly of the mechanism, as described below.

The locking assembly 36 is supported in the holes 66 or 68 of the front bracket 32, and generally includes a handle 70, a pawl 72, and a spring 74. The handle 70 includes a first end sized for receipt in a pair of the holes 66, 68, and an opposed second end having a gripping portion 76 by which the handle can be manipulated. A clip 77 is provided for retaining the first end of the handle in place on the front bracket 32 while allowing the handle to rotate within the pair of holes. The pawl 72 includes an aperture by which it is received on the first end of the handle, and the handle and pawl are keyed or otherwise fastened together so that the pawl rotates about the axis defined by the holes 66 or 68 when the second end of the handle is raised or lowered. Preferably, the handle and pawl are each formed with a transverse hole, and a pin 78 is driven into the holes to fix the pawl on the handle. However, any other suitable fastening expedient may be employed.

The pawl 72 includes a free end opposite the handle, and the free end presents an upwardly extending arm 80 that extends through the aperture 62 in the bracket 32 and is dimensioned for receipt in the apertures 46 of the seat mounting plate 38. Preferably, the front and back sides of the pawl arm 80 are tapered slightly to remove any play or lost motion from between the mounting plate and the pawl when the pawl is engaged with the apertures 46.

The spring 74 is a torsion spring, including a first end that bears against the underside of the front bracket, and a second end that is received in a hole in the pawl. The spring biases the pawl and handle toward a locked position in which the pawl 72 is engaged with the apertures 46 of the mounting plate such that the mechanism remains locked against fore and aft shifting movement. In order to adjust the position of the seat relative to the backrest, it is necessary to lift the handle 70 against the bias of the spring 74 and maintain this upward force on the handle during the adjustment. Thereafter, when the handle is released, the pawl 72 is biased upward and engages one of the apertures 46 that is aligned with the aperture 62 in the front bracket 32 to lock the seat against further adjustment. If none of the apertures 46 are aligned with the pawl 72 when the handle is released, the pawl will remain biased toward the locked position such that any additional shifting movement of the seat in either direction will bring one of the apertures into the necessary alignment and allow the pawl to engage the mounting plate.

The locking assembly 36 is illustrated in FIG. 3 as being mounted in the left-hand pair of holes 66 in the front bracket. As such, a user is able to operate the handle with his or her left hand. Optionally, the locking assembly can be constructed for use in a right-handed mode, wherein the handle, pawl and spring are supported in the right-hand pair of holes 68 of the front bracket.

In order to reduce the friction between the guides 40 and the rails 24 to a minimum, the tracks 34 are provided which are interposed between the rails and the guides, as shown in FIG. 4. The tracks 34 are generally U-shaped channels that present an inner height adapted to fit snugly on the rails 24 and an outer height sized for sliding receipt within the guides 40 of the mounting assembly. Preferably, the tracks 34 are formed of a synthetic resin material such as a linear polyoxymethylene-type acetal resin, an example of which is marketed under the trade name DELRIN, having reduced friction relative to the metal rails. Further, in the preferred embodiment, the tracks and guides are formed of different materials to reduce or eliminate squeaking between the elements during relative shifting movement of the guides.

As shown in FIG. 2, in order to mount the mechanism 26 on a chair, the brackets 30, 32 are fastened to the ends of the rails 24 by fasteners 57 and the tracks 34 are fitted over the outer lateral edges of the rails. Thereafter, the guides 40 are placed in position along the tracks, with the tracks received in the channels defined by the guides, and the guides are fastened to the seat mounting plate 38. A right or left handed locking assembly is preferably assembled on the front bracket prior to assembly of the brackets on the rails. If tension springs 50, shown in FIG. 3, are to be fastened between the mounting plate and the rear bracket, they are seated in the apertures 48, 56, and the mounting plate 38 is then secured to the rigid seat bottom by suitable fasteners. Finally, the seat mounting plate 38 is secured to the seat by conventional fasteners.

During use of the chair, the horizontal adjustment mechanism 26 is normally locked by the engagement of the pawl 72 with one of the apertures 46 of the mounting plate. This condition is maintained by the torsion spring 74. As such, normal operation of the tilt control mechanism is possible, including height adjustment, tilt control and setting of the forward stop angle of the seat. Other functions of the tilt control mechanism can also be carried out without restriction from the horizontal adjustment mechanism.

When a user desires to adjust the fore and aft position of the seat relative to the backrest, they lift the handle 70, pivoting the pawl 72 to the unlocked position. As the pawl is removed from the apertures in the mounting plate, the seat is free to slide along the rails within the range of motion limited by the end brackets, as illustrated in FIG. 5. At the desired position of the seat, the handle is released, allowing the pawl to be biased back into the locked position.

Although the horizontal adjustment mechanism is illustrated as being used in combination with a tilt control mechanism, it is understood that it could be interposed directly between the base and seat of a chair so long as the base presents a seat mounting structure having a pair of laterally spaced longitudinally extending edges along which the seat mounting assembly can be guided for sliding movement. Likewise, it is possible to construct a tilt control mechanism that incorporates the principals of the present invention into a single mechanism. For example, a tilt control mechanism could be constructed with rails that are integrally formed with structure that accomplishes the function of the end brackets such that the use of such brackets is obviated. As such, although the invention has been described with reference to the preferred embodiment illustrated in the attached drawing figures, it is noted that substitutions may be made and equivalents employed herein without departing from the scope of the invention as recited in the claims.

We claim:

1. In a chair having a base, a seat, a backrest, and a tilt control mechanism which allows the seat to be tilted relative to the base, wherein the tilt control mechanism includes a mounting structure by which the control mechanism is adapted to be fastened to the seat, the mounting structure including a pair of laterally spaced longitudinally extending edges, a horizontal adjustment mechanism comprising:

a seat mounting assembly including a pair of laterally spaced guides adapted to engage the edges of the control mechanism mounting structure for sliding movement on the control mechanism in a first direction, and tracks sized for receipt over the lateral edges of the control mechanism mounting structure, the tracks presenting reduced friction engagement surfaces relative to the edges of the control mechanism mounting structure to reduce friction exerted on the guides of the seat mounting assembly.

2. In the chair as recited in claim 1, the horizontal adjustment mechanism further comprising a bracket assembly adapted to be fastened to the control mechanism mounting structure to restrict the range of sliding movement of the seat mounting assembly relative to the control mechanism.

3. In the chair as recited in claim 2, the bracket assembly including a pair of brackets adapted to be fastened to the control mechanism mounting structure.

4. In the chair as recited in claim 2, the horizontal adjustment mechanism further comprising at least one spring connected between the mounting assembly and the bracket assembly for biasing the mounting assembly toward a rearward most position.

5. In the chair as recited in claim 2, the seat mounting assembly presenting a plurality of apertures aligned in the first direction, the horizontal adjustment mechanism further comprising:

a pawl supported for movement between an unlocked position out of engagement with the apertures and a locked position engaging one of the apertures, the pawl locking the seat mounting assembly and seat in one of a plurality of fore and aft positions relative to the control mechanism when in the locked position;

a handle engaging the pawl and supported on the bracket assembly for pivoting movement so that movement of the handle shifts the pawl between the locked and unlocked positions; and a spring for biasing the pawl toward the locked position.

6. In the chair as recited in claim 5, the bracket assembly including a first pair of apertures for supporting the handle, pawl and spring in a first orientation adapted for right-handed use, and a second pair of apertures for supporting the handle, pawl and spring in a second orientation adapted for left-handed use.

7. In the chair as recited in claim 1, the seat mounting assembly presenting a plurality of apertures aligned in the first direction, the horizontal adjustment mechanism further comprising a pawl supported for movement between an unlocked position out of engagement with the apertures and a locked position engaging one of the apertures, the pawl locking the seat mounting assembly and seat in one of a plurality of fore and aft positions relative to the control mechanism when in the locked position.

8. In the chair as recited in claim 1, the seat mounting assembly including a mounting plate defining a plurality of mounting holes, and the laterally spaced guides being spaced from one another on the mounting plate by a distance that can be adjusted in order to fit the mounting assembly on the edges of the control mechanism mounting structure for relative sliding movement.

9. An adjustment mechanism for use with a chair having a base, a seat defining a fore-to-aft longitudinal axis, and a backrest, the mechanism comprising:

a housing adapted to be fastened to the base;

a pair of rails supported on the housing for pivoting movement about a horizontal axis that is transverse to the longitudinal axis, the rails presenting laterally spaced longitudinally extending edges;

a pair of end brackets that are spaced longitudinally from one another and fastened to the rails;

a low-profile seat mounting assembly adapted to be fastened to the seat, the seat mounting assembly including a pair of laterally spaced guides received over the edges of the rails between the brackets for sliding movement on the rails within a limited range of movement in the longitudinal direction, the seat mounting assembly presenting a plurality of apertures aligned in the longitudinal direction; and a pawl supported on one of the end brackets for movement between an unlocked position out of engagement with the apertures and a locked position engaging one of the apertures, the pawl locking the seat mounting assembly and seat in one of a plurality of fore and aft positions relative to the rails when in the locked position.

10. The adjustment mechanism as recited in claim 9, further comprising at least one spring connected between the mounting assembly and one of the end brackets for biasing the mounting assembly toward a rearward most position.

11. The adjustment mechanism as recited in claim 9, wherein the seat mounting assembly includes a mounting plate having a set of mounting holes and the laterally spaced guides are spaced from one another on the mounting plate by a distance that can be adjusted in order to fit the mounting assembly on the rails for relative sliding movement.

12. An adjustment mechanism for use with a chair having a base, a seat defining a fore-to-aft longitudinal axis, and a backrest, the mechanism comprising:

a housing adapted to be fastened to the base;

a pair of rails supported on the housing for pivoting movement about a horizontal axis that is transverse to the longitudinal axis, the rails presenting laterally spaced longitudinally extending edges;

a pair of end brackets that are spaced longitudinally from one another and fastened to the rails;

a low-profile seat mounting assembly adapted to be fastened to the seat, the seat mounting assembly including a pair of laterally spaced guides received over the edges of the rails between the brackets for sliding movement on the rails within a limited range of movement in the longitudinal direction; and tracks sized for receipt over the lateral edges of the rails, the tracks presenting reduced friction engagement surfaces relative to the edges of the rails to reduce friction exerted on the guides of the seat mounting assembly.

13. An adjustment mechanism for use with a chair having a base, a seat defining a fore-to-aft longitudinal axis, and a backrest, the mechanism comprising:

a housing adapted to be fastened to the base;

a pair of rails supported on the housing for pivoting movement about a horizontal axis that is transverse to the longitudinal axis, the rails presenting laterally spaced longitudinally extending edges;

a pair of end brackets that are spaced longitudinally from one another and fastened to the rails;

a low-profile seat mounting assembly adapted to be fastened to the seat, the seat mounting assembly including a pair of laterally spaced guides received over the edges of the rails between the brackets for sliding movement on the rails within a limited range of movement in the longitudinal direction, the seat mounting presenting a plurality of longitudinally aligned apertures;

a pawl supported for movement between an unlocked position out of engagement with the apertures and a locked position engaging one of the apertures, the pawl locking the seat mounting assembly and seat in one of a plurality of fore and aft positions relative to the housing when in the locked position;

a handle engaging the pawl and supported on one of the brackets for pivoting movement so that movement of the handle shifts the pawl between the locked and unlocked positions; and a spring for biasing the pawl toward the locked position.

14. The adjustment mechanism as recited in claim 13, wherein one of the brackets includes a first pair of apertures for supporting the handle, pawl and spring in a first orientation adapted for right-handed use, and a second pair of apertures for supporting the handle, pawl and spring in a second orientation adapted for left-handed use.

15. A chair comprising:

a base;

a seat defining a fore-to-aft longitudinal axis;

a backrest;

a pair of rails supported on the base for pivoting movement about a horizontal axis that is transverse to the longitudinal axis defined by the seat, the rails presenting laterally spaced longitudinally extending edges;

a pair of end brackets that are spaced longitudinally from one another and fastened to the fails;

a low-profile seat mounting assembly adapted to be fastened to the seat, the seat mounting assembly including a pair of laterally spaced guides received over the edges of the rails between the brackets to support the seat mounting assembly for sliding movement on the rails within a limited range of movement in the longitudinal direction; and tracks sized for receipt over the lateral edges of the rails, the tracks presenting reduced friction engagement surfaces relative to the edges of the rails to reduce friction exerted on the guides of the seat mounting assembly.

16. The chair as recited in claim 15, wherein the seat mounting assembly presents a plurality of apertures aligned along the direction of movement of the seat, the chair further comprising a pawl supported on one of the end brackets for movement between an unlocked position out of engagement with the apertures and a locked position engaging one of the apertures, the pawl locking the seat mounting assembly and seat in one of a plurality of fore and aft positions relative to the rails when in the locked position.

17. The chair as recited in claim 15, further comprising at least one spring connected between the mounting assembly and one of the end brackets for biasing the mounting assembly toward a rearward most position.

18. The chair as recited in claim 15, wherein the seat mounting assembly includes a mounting plate defining a plurality of mounting holes, and the laterally spaced guides are spaced from one another on the mounting plate by a distance that can be adjusted in order to fit the mounting assembly on the rails for relative sliding movement.

19. The chair as recited in claim 15, wherein the seat mounting assembly presents a plurality of longitudinally aligned apertures, the chair further comprising:

a pawl supported for movement between an unlocked position out of engagement with the apertures and a locked position engaging one of the apertures, the pawl locking the seat mounting assembly and seat in one of a plurality of fore and aft positions relative to the housing when in the locked position;

a handle engaging the pawl and supported on one of the brackets for pivoting movement so that movement of the handle shifts the pawl between the locked and unlocked positions; and a spring for biasing the pawl toward the locked position.

20. The chair as recited in claim 19, wherein one of the brackets includes a first pair of apertures for supporting the handle, pawl and spring in a first orientation adapted for right-handed use, and a second pair of apertures for supporting the handle, pawl and spring in a second orientation adapted for left-handed use.

* * * * *